US011173588B2

(12) United States Patent
Sun

(10) Patent No.: US 11,173,588 B2
(45) Date of Patent: Nov. 16, 2021

(54) MULTIFUNCTIONAL SCREWDRIVER PROVIDED WITH SCREW FINDER

(71) Applicant: SHANGHAI EASY-USE TOOLS ENTERPRISE CO., LTD, Shanghai (CN)

(72) Inventor: Shiyu Sun, Shanghai (CN)

(73) Assignee: SHANGHAI EASY-USE TOOLS ENTERPRISE CO., LTD., Shanghai (CN)

( * ) Notice: Subject to any disclaimer, the term of this patent is extended or adjusted under 35 U.S.C. 154(b) by 338 days.

(21) Appl. No.: 16/480,153

(22) PCT Filed: Jan. 18, 2018

(86) PCT No.: PCT/CN2018/073288
§ 371 (c)(1),
(2) Date: Jul. 23, 2019

(87) PCT Pub. No.: WO2018/121796
PCT Pub. Date: Jul. 5, 2018

(65) Prior Publication Data

US 2021/0276165 A1 Sep. 9, 2021

(30) Foreign Application Priority Data

Dec. 29, 2016 (CN) ..... 201621467722.9

(51) Int. Cl.
*B25B 23/00* (2006.01)
*B25B 23/12* (2006.01)
(Continued)

(52) U.S. Cl.
CPC ..... *B25B 23/005* (2013.01); *B25B 23/0035* (2013.01); *B25B 23/12* (2013.01); *B25G 1/085* (2013.01); *B67B 7/16* (2013.01)

(58) Field of Classification Search
CPC ... B25B 23/00; B25B 23/005; B25B 23/0035; B25B 15/00; B25B 15/02; B67B 7/16; B67B 7/18; B25G 1/085
See application file for complete search history.

(56) References Cited

U.S. PATENT DOCUMENTS 4,979,407 A * 12/1990 Hernandez ..... B67B 7/44 81/3.09
5,896,606 A 4/1999 Huang
(Continued)

FOREIGN PATENT DOCUMENTS

CN 2877971 Y 3/2007
CN 201455876 U 5/2010
(Continued)

*Primary Examiner* — David B. Thomas
(74) *Attorney, Agent, or Firm* — Andrew F. Young; Nolte Lackenbach Siegel

(57) ABSTRACT

A multifunctional screwdriver with a screw finder comprises a bottle opener mounted on a handle and a screw finder threaded connected to the end of the handle. The screw finder comprises a tail cover with a through hole formed in its inner wall, a universal joint with a gibbosity arranged on each side of its outer circle wall, a magnet frame and a magnet. The universal joint is mounted in the tail cover through the gibbosity and the through hole. The magnet frame with the magnet embedded therein is mounted in the universal joint. When the magnet approaches to the screw, the universal joint and the magnet rotate due to the magnetic force, and the mounting position of the screw can be found. When the screwdriver is not used, the screwdriver can be directly hung to a wall through the bottle opener with a function of opening a bottle cover.

4 Claims, 1 Drawing Sheet

(51) Int. Cl.
*B67B 7/16* (2006.01)
*B25G 1/08* (2006.01)

(56) References Cited

U.S. PATENT DOCUMENTS

| | | | | |
|---|---|---|---|---|
| 10,150,222 | B2 * | 12/2018 | Raymond | B43L 9/04 |
| 10,611,012 | B2 * | 4/2020 | Adelman | B25F 1/00 |
| 2018/0257212 | A1 * | 9/2018 | Preston | B66F 15/00 |
| 2018/0281166 | A1 * | 10/2018 | Chmelar | B25B 13/06 |

FOREIGN PATENT DOCUMENTS

| | | | |
|---|---|---|---|
| CN | 201475663 | U | 5/2010 |
| CN | 102039572 | A | 5/2011 |
| CN | 206493259 | | 9/2017 |
| FR | 2662966 | A1 | 12/1991 |

* cited by examiner

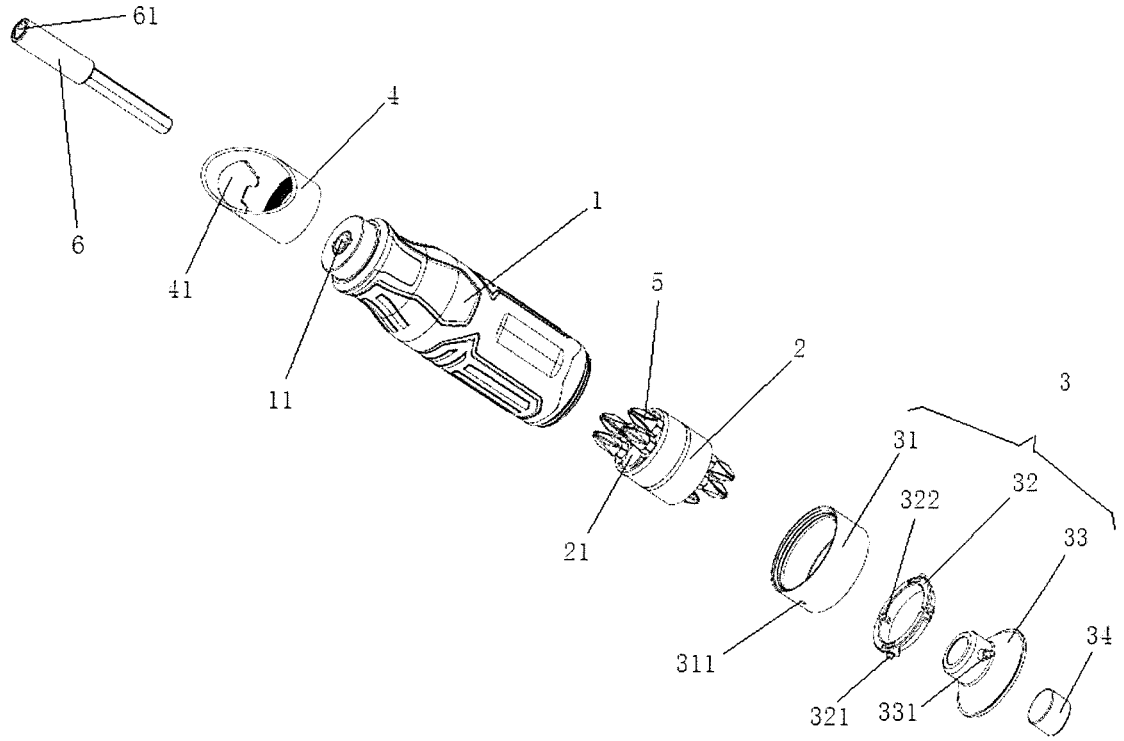
61
6
4
41
1
11
5
2
21
3
31
311
322
32
321
33
331
34

MULTIFUNCTIONAL SCREWDRIVER PROVIDED WITH SCREW FINDER

CROSS-REFERENCE TO RELATED APPLICATIONS

The present application is a national phase of Ser. No. PCT/CN2018/073288 filed Jan. 18, 2018, the entire contents of which are incorporated herein by reference, and which claims priority to and the benefit of Chinese Patent Application No. 201621467722.9 filed Dec. 29, 2016.

BACKGROUND OF THE INVENTION

1. Field of the Invention

The invention relates to a hardware tool, and more particularly, to a multifunctional screwdriver provided with a screw finder.

2. Description of the Related Art

Screwdrivers have a function of tightening screws. However, when it is desired to loosen the screw, a user needs to find the screw first, but it is hard to find the screw after assembly is completed. For example, it is not easy to find parts in the wall since wall paint is applied to or wall paper is attached to the wall, and screws in wood of furniture are hard to find after paint is applied to the furniture. The existing screwdriver does not have the function of finding the screw. Therefore, the present invention provides a screwdriver which is capable of finding the position of the screw, such that the screw can be found easily, and the use efficiency and range of application may be increased.

SUMMARY OF THE INVENTION

In order to solve the problem that it is really hard and inconvenient for an operator to find the mounting position of a screw when loosening the screw, the present invention provides a multifunctional screwdriver provided with a screw finder.

To this end, the present invention provides a multifunctional screwdriver provided with a screw finder, comprising:

a handle, a bottle opener being detachably mounted on a head of the handle, further comprising the screw finder, connected to a tail end of the handle.

In the above-mentioned multifunctional screwdriver provided with a screw finder, wherein the screw finder comprises a tail cover, a universal joint, a magnet frame, and a magnet; the universal joint is mounted in the tail cover; the magnet frame is mounted in the universal joint, and the magnet is embedded in the magnet frame.

In the above-mentioned multifunctional screwdriver provided with a screw finder, wherein a bottle opening is formed in the bottle opener.

In the above-mentioned multifunctional screwdriver provided with a screw finder, further comprising a screwdriver bit frame, wherein the screwdriver bit frame is mounted in an interior space of the handle, a plurality of screwdriver bits and a screwdriver tool rod are mounted on the screwdriver bit frame, the other end of the screwdriver tool rod is detachably inserted into the head of the handle, and the handle is provided with an insertion hole which is fitted with the screwdriver tool rod.

The present invention has the following beneficial effects:

The screw finder is mounted on the screwdriver, and a screw is found by means of a magnet in the screw finder. When the magnet approaches to the screw, magnetic force is generated between the magnet and the screw, the universal joint and the magnet rotate, and the mounting position of the screw can be found.

BRIEF DESCRIPTION OF THE DRAWINGS

The accompanying drawings, together with the specification, illustrate exemplary embodiments of the present disclosure, and, together with the description, serve to explain the principles of the present invention.

FIG. 1 is an exploded view of a multifunctional screwdriver provided with a screw finder in this embodiment.

DETAILED DESCRIPTION

The present invention will now be described more fully hereinafter with reference to the accompanying drawings, in which exemplary embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like reference numerals refer to like elements throughout.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," or "includes" and/or "including" or "has" and/or "having" when used herein, specify the presence of stated features, regions, integers, steps, operations, elements, and/or components, but do not preclude the presence or addition of one or more other features, regions, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

As used herein, the term "plurality" means a number greater than one.

Hereinafter, certain exemplary embodiments according to the present disclosure will be described with reference to the accompanying drawings.

Example

With reference to FIG. 1, a multifunctional screwdriver provided with a screw finder according to a preferred embodiment is shown which comprises:

a handle 1 having an interior hollow structure, wherein the handle 1 in this embodiment is of a hollow structure, a tail end of the handle 1 has external threads, an insertion hole 11 is formed in a surface of a head of the handle and it may be disposed in other parts of the head of the handle, and a screwdriver tool rod 6 may be inserted therein without affecting its performance; a bottle opener 4 may be detachably or fixedly mounted on the head of the handle; when the screwdriver in this embodiment is not used, the screwdriver tool rod 6 is removed from the head of the handle 1 and is placed in the following screwdriver frame 2, and an opening of the bottle opener 4 is hung to any accessible places, wherein, the multifunctional screwdriver provided with a screw finder further comprises the screw finder 3, in a threaded connection with the tail end of the handle 1, through which the specific position of the screw may be found.

The present invention also has the following implementation based on the above-mentioned example, as shown in FIG. 1 again, in a further embodiment of the present invention, the screw finder 3 comprises a tail cover 31, a universal joint 32 a magnet frame 33, and a magnet 34; a gibbosity 321 is arranged on each of the two opposite sides of an outer circle wall of the universal joint 32; a through hole 311 is formed in the inner wall of the tail cover 31 corresponding to the gibbosity 321; the universal joint 32 is mounted in the tail cover 31 by means of the gibbosity 321 and the through hole 311; the magnet frame 33 is mounted in the universal joint 32, and the magnet 34 is embedded in the magnet frame 33.

In a further embodiment of the present invention, a pair of gibbosities 331 are disposed in an outer surface of the magnet frame 33; a mounting groove 322 is formed in a junction of the universal joint 32 and the magnet frame 33, and the magnet frame 33 is mounted in the universal joint 32 by the combination of the gibbosities 331 and the mounting groove 322.

In a further embodiment of the present invention, a bottle opening 41 is formed in the bottle opener 4.

In a further embodiment of the present invention, further comprising a screwdriver bit frame 2, mounted in the interior space of the handle 1, wherein the screwdriver bit frame 2 is a cylinder and has a plurality of through holes 21 in an axial direction, a plurality of screwdriver bits 5 and a screwdriver tool rod 6 may be inserted into the plurality of through holes 21; the plurality of screwdriver bits 5 and the screwdriver tool rod 6 is mounted on the screwdriver bit frame 2; one end of the screwdriver tool rod 6 has an internal angle counter bore 61, and the other end thereof is detachably inserted into the head of the handle 1, and the handle 1 is provided with an insertion hole 11 which is fitted with the screwdriver tool rod.

Users may further understand the features and functions of a multifunctional screwdriver provided with a screw finder according to the present invention from the description below.

This embodiment discloses a screwdriver. A screwdriver bit frame 2 is mounted in the handle 1, and a plurality of screwdriver bits 5 and a screwdriver tool rod 6 are mounted on the screwdriver bit frame 2. One end of the screwdriver tool rod 6 may be inserted into an insertion hole 11, and the other end thereof has an internal angle counter bore 61, preferably a hexagonal counter bore. A bottle opener 4 is in a threaded connection with the head of the handle 1, a bottle opening 41 is formed on the bottle opener 4, and the bottle opener may open the bottle cover of bottles such as wine bottles and soy sauce bottles through the bottle opening 41. A screw finder 3 is in a threaded connection with the tail end of the handle 1, through which the specific position of the screw may be found.

Usage for the screwdriver in this embodiment is provided below:

The screw finder 3 is removed from the handle 1 by rotating the screw finder 3 along the threads of the handle 1. A horn mouth of the magnet frame 33 of the screw finder 3 (as shown in the magnet frame 33 in FIG. 1) is aligned with a surface of an object to which the screw is mounted, and the screw finder 3 is moved back and forth. When the screw finder 3 approaches to the screw, magnetic force is generated between the screw and the magnet 43 since the screw is made of a metal material. The movement of the screw finder 3 with respect to the screw may cause the magnet frame 33, in which the magnet 34 is embedded, and the universal joint 32, in which the magnet frame 33 is mounted, to rotate, the magnet frame 33 and the universal joint 32 rotate around the gibbosity 331. In the end, the screw is accurately positioned and its mounting position is found after multiple movements.

After the screw finder 3 is removed, the screwdriver bit frame 2 is removed from inside of the handle 1, the screwdriver tool rod 6 mounted on the screwdriver bit frame 2 is taken out and is inserted in the insertion hole 11, then the screwdriver bit 5 is removed and inserted into the internal angle counter bore 61, finally the screw may be pre-tightened or loosened by using the screwdriver. When the screwdriver is not used, the bottle opening 41 of the bottle opener 4 is hung to the wall. In addition, the magnet frame 33 is in a disk shape, and an inner surface of the disk-shaped portion may absorb screws due to magnetic force of the magnet 34 and may be used for storing parts such screws, such that the screws are not easy to lose.

In conclusion, in the present invention, the screw finder is mounted on the screwdriver, and a screw is found by means of a magnet in the screw finder. When the magnet approaches to the screw, magnetic force is generated between the magnet and the screw, the universal joint and the magnet rotate, and the mounting position of the screw can be found.

The above descriptions are only the preferred embodiments of the invention, not thus limiting the embodiments and scope of the invention. Those skilled in the art should be able to realize that the schemes obtained from the content of specification and drawings of the invention are within the scope of the invention.

What is claimed is:

1. A multifunctional screwdriver provided with a screw finder, comprising:

a handle, a bottle opener being detachably mounted on a head of the handle, further comprising the screw finder, connected to a tail end of the handle.

2. The multifunctional screwdriver provided with a screw finder of claim 1, wherein the screw finder comprises a tail cover, a universal joint, a magnet frame, and a magnet; the universal joint is mounted in the tail cover; the magnet frame is mounted in the universal joint, and the magnet is embedded in the magnet frame.

3. The multifunctional screwdriver provided with a screw finder of claim 1, wherein a bottle opening is formed in the bottle opener.

4. The multifunctional screwdriver provided with a screw finder of claim 1, further comprising a screwdriver bit frame, wherein the screwdriver bit frame is mounted in an interior space of the handle, a plurality of screwdriver bits and a screwdriver tool rod are mounted on the screwdriver frame, the other end of the screwdriver tool rod is detachably inserted into the head of the handle, and the handle is provided with an insertion hole which is fitted with the screwdriver tool rod.

* * * * *